US011619417B2

(12) United States Patent
Duff et al.

(10) Patent No.: US 11,619,417 B2
(45) Date of Patent: Apr. 4, 2023

(54) CONTACT WHEEL DRIVE

(71) Applicant: Broan-NuTone LLC, Hartford, WI (US)

(72) Inventors: Gabriel Duff, Drummondville (CA); Simon Tourangeau, Drummondville (CA); Daniel Marcoux, Drummondville (CA)

(73) Assignee: Broan-NuTone LLC, Hartford, WI (US)

( * ) Notice: Subject to any disclaimer, the term of this patent is extended or adjusted under 35 U.S.C. 154(b) by 0 days.

(21) Appl. No.: 17/675,572

(22) Filed: Feb. 18, 2022

(65) Prior Publication Data

US 2022/0333812 A1 Oct. 20, 2022

Related U.S. Application Data

(60) Provisional application No. 63/175,391, filed on Apr. 15, 2021.

(51) Int. Cl.
*F24F 12/00* (2006.01)

(52) U.S. Cl.
CPC ..... *F24F 12/006* (2013.01); *F24F 2012/008* (2013.01); *F24F 2203/1004* (2013.01)

(58) Field of Classification Search
CPC ..... F24F 12/006; F24F 2012/008; F24F 2203/1004; F24F 2203/1032; F24F 12/001; F24F 3/1423
USPC ..... 165/66
See application file for complete search history.

(56) References Cited

U.S. PATENT DOCUMENTS

| | | | | |
|---|---|---|---|---|
| 4,188,993 | A | 2/1980 | Hanson | |
| 4,589,892 | A * | 5/1986 | Leonard | F24F 3/1423 96/115 |
| 5,183,098 | A | 2/1993 | Chagnot | |
| 5,752,323 | A | 5/1998 | Hashimoto | |
| 5,937,667 | A * | 8/1999 | Yoho, Sr. | F24F 3/1423 62/271 |
| 6,422,299 | B1 | 7/2002 | Eriksson | |
| 9,353,868 | B2 | 5/2016 | Julien et al. | |
| 2005/0236150 | A1 * | 10/2005 | Chagnot | F24F 12/006 165/8 |

FOREIGN PATENT DOCUMENTS

| | | |
|---|---|---|
| CA | 2373417 | 11/2001 |
| JP | H1061977 | 3/1998 |
| JP | 2012057940 | 3/2012 |

OTHER PUBLICATIONS

Kinze Ground Contact Drive, available online at: shorturl.at/lovE4, 2022 (2 pages).

(Continued)

*Primary Examiner* — Steve S Tanenbaum
(74) *Attorney, Agent, or Firm* — Barnes & Thornburg LLP

(57) ABSTRACT

An energy recovery system for an air handling unit includes a support frame, an energy recovery wheel, and a wheel actuator. The support frame supports the energy recovery wheel within the air handling unit. The energy recovery wheel is configured to rotate about a rotation axis during operation. The wheel actuator is configured to drive the energy recovery wheel to rotate about the rotation axis.

16 Claims, 13 Drawing Sheets

(56) References Cited

OTHER PUBLICATIONS

Lift Tech Marine Wheel Drive Shore Station Installation Guide (1 page).
Lift Tech Marine MC Wheel Drive Installation Guide (2 pages).
Lift Tech Marine Wheel Drive AC / DC Owners Manual (2 pages).
Thermotech Enterprises Thermowheel TR Series Retrofit Wheel Systems, 2019 (8 pages).
European Patent Application No. 22166879.1, Search Report dated Dec. 12, 2022 (13 pages).

* cited by examiner

CONTACT WHEEL DRIVE

PRIORITY CLAIM

This application claims priority under 35 U.S.C. § 119(e) to U.S. Provisional Application Ser. No. 63/175,391, filed Apr. 15, 2021, which is expressly incorporated by reference herein.

BACKGROUND

The present disclosure relates to an energy recovery system, and particularly to an energy recovery system for an air handling unit. More particularly, the present disclosure relates to an energy recovery system that includes an energy recovery wheel that is driven in rotation about an axis to exchange energy between airflows.

SUMMARY

According to the present disclosure, an energy recovery system for an air handling unit includes an energy recovery wheel configured to rotate about a central axis. The energy recovery system further includes a wheel actuator including a motor and a drive wheel coupled to the motor for rotation about a wheel axis that is offset from the central axis and the energy recovery wheel to drive rotation of the energy recovery wheel about the central axis.

In some embodiments, the energy recovery system further includes an actuator mount configured to position and retain the wheel actuator relative to the energy recovery wheel. The actuator mount includes a stationary mount coupled in a fixed position relative to the energy recovery wheel, a motor mount coupled to the stationary mount for pivotable movement about an actuator pivot axis and configured to support the wheel actuator relative to the energy recovery wheel, and a tensioning system configured to bias the motor mount to pivot about the actuator pivot axis so that the drive wheel is biased into contact with the energy recovery wheel.

In some embodiments, the tensioning system includes a tension spring coupled to a first end of the motor mount to bias an opposite, second end of the motor mount toward the energy recovery wheel, the drive wheel being coupled to the motor at the second end of the motor mount.

In some embodiments, the tensioning system further includes an adjustable spring mount coupled to the motor mount, and wherein the tension spring is coupled to an end of the spring mount spaced apart from the motor mount at the first end to bias the second end of the motor mount toward the energy recovery wheel. In some embodiments, the adjustable spring mount is rotatable relative to the motor mount to increase or decrease a spring force provided by the tension spring on the adjustable spring mount.

In some embodiments, the motor mount includes a mount plate supporting the wheel actuator, a mount rod extending along the actuator pivot axis, and a vibration dampening bushing coupled to the mount rod and arranged to lie between the mount rod and the stationary mount to dampen vibrations produced by the actuator. In some embodiments, the motor mount includes a first mount flange formed to include a first flange aperture, a second mount flange spaced apart from the first mount flange along the actuator pivot axis and formed to include a second flange aperture, and a mount pin received within the first mount flange, the second mount flange, and at least one stationary-mount aperture formed in the stationary mount to couple the motor mount and the wheel actuator to the stationary mount.

In some embodiments, the energy recovery system further includes a first vibration dampening bushing arranged to lie between the mount pin and the first mount flange and a second vibration dampening bushing arranged to lie between the mount pin and the second mount flange.

In accordance with a second aspect of the present disclosure, an energy recovery system for an air handling unit includes an energy recovery wheel configured to rotate about a first axis, a motor, and a drive wheel coupled to the motor for rotation about a second axis that is offset from the first axis and the energy recovery wheel and having an outer surface engaged directly with an outer surface of the energy recovery wheel.

In some embodiments, the energy recovery system further includes a tensioning system configured to bias the motor to pivot about an actuator pivot axis so that the drive wheel is urged into contact with the outer surface of the energy recovery wheel. In some embodiments, the tensioning system includes an adjustable spring mount coupled to the motor and a tension spring coupled to the adjustable spring mount. In some embodiments, the adjustable spring mount is adjustable relative to the motor to increase or decrease a spring force provided by the tension spring on the adjustable spring mount.

In some embodiments, the energy recovery system further includes a actuator mount configured to support the motor relative to the energy recovery wheel, the actuator mount including a motor mount coupled to the motor and a stationary mount coupled to the air handling unit in a fixed position and configured to support the motor mount for pivotable movement about an actuator pivot axis so that the drive wheel is pivoted into contact with the outer surface of the energy recovery wheel. In some embodiments, the motor mount includes a mount plate supporting the motor, a pair of mount flanges coupled to the mount plate, and a mount rod coupled to the mount flanges and providing the actuator pivot axis.

In some embodiments, the energy recovery system further includes a vibration dampening bushing coupled to the mount rod and arranged to lie between the mount rod and at least one of the stationary mount and the mount plate to dampen vibrations therebetween.

According to a third aspect of the present disclosure, an energy recovery system for an air handling unit includes a support frame including a plurality of side frame members at least partially defining an air-supply section and an air-return section and a seal member arranged between the air-supply section and the air-return section. In some embodiments, the energy recovery system further includes an energy recovery wheel positioned within the air-supply section and the air-return section and configured to rotate about a rotation axis that is between the air-supply section and the air-return section, the energy recovery wheel including an outer shell extending circumferentially around the rotation axis and energy absorption media between the outer shell and the rotation axis.

In some embodiments, the energy recovery system further includes a wheel actuator configured to drive the energy recovery wheel to rotate about the rotation axis. In some embodiments, the seal member interfaces with a radially-outer surface of the outer shell and extends generally parallel with the rotation axis from a forward end of the outer shell to a rear end of the outer shell and is formed without any slots opening toward the outer shell between the forward end and the rear end.

In some embodiments, the energy recovery system further includes an actuator mount configured to position and retain the wheel actuator relative to the energy recovery wheel, the actuator mount including a stationary mount coupled in a fixed position relative to the energy recovery wheel, a motor mount coupled to the stationary mount for pivotable movement about an actuator pivot axis and configured to support the wheel actuator relative to the energy recovery wheel, and a tensioning system configured to bias the motor mount to pivot about the actuator pivot axis so that the wheel actuator is biased into contact with the energy recovery wheel.

In some embodiments, the tensioning system includes an adjustable spring mount coupled to the motor mount and a tension spring coupled to the adjustable spring mount. In some embodiments, the adjustable spring mount is adjustable relative to the motor mount to increase or decrease a spring force provided by the tension spring on the adjustable spring mount. In some embodiments, the motor mount includes a mount plate configured to support a motor of the wheel actuator, a pair of mount flanges coupled to the mount plate, and a mount rod coupled to the mount flanges and providing the actuator pivot axis.

In some embodiments, the energy recovery system further includes a vibration dampening bushing coupled to the mount rod and arranged to lie between the mount rod and at least one of the stationary mount and the mount plate to dampen vibrations. In some embodiments, the wheel actuator includes a motor and a drive wheel driven in rotation by the motor, and wherein the drive wheel is biased into direct contact with the radially-outer surface of the energy recovery wheel so that only the drive wheel drives the energy recovery wheel to rotate about the rotation axis.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

DETAILED DESCRIPTION

Figure 1:
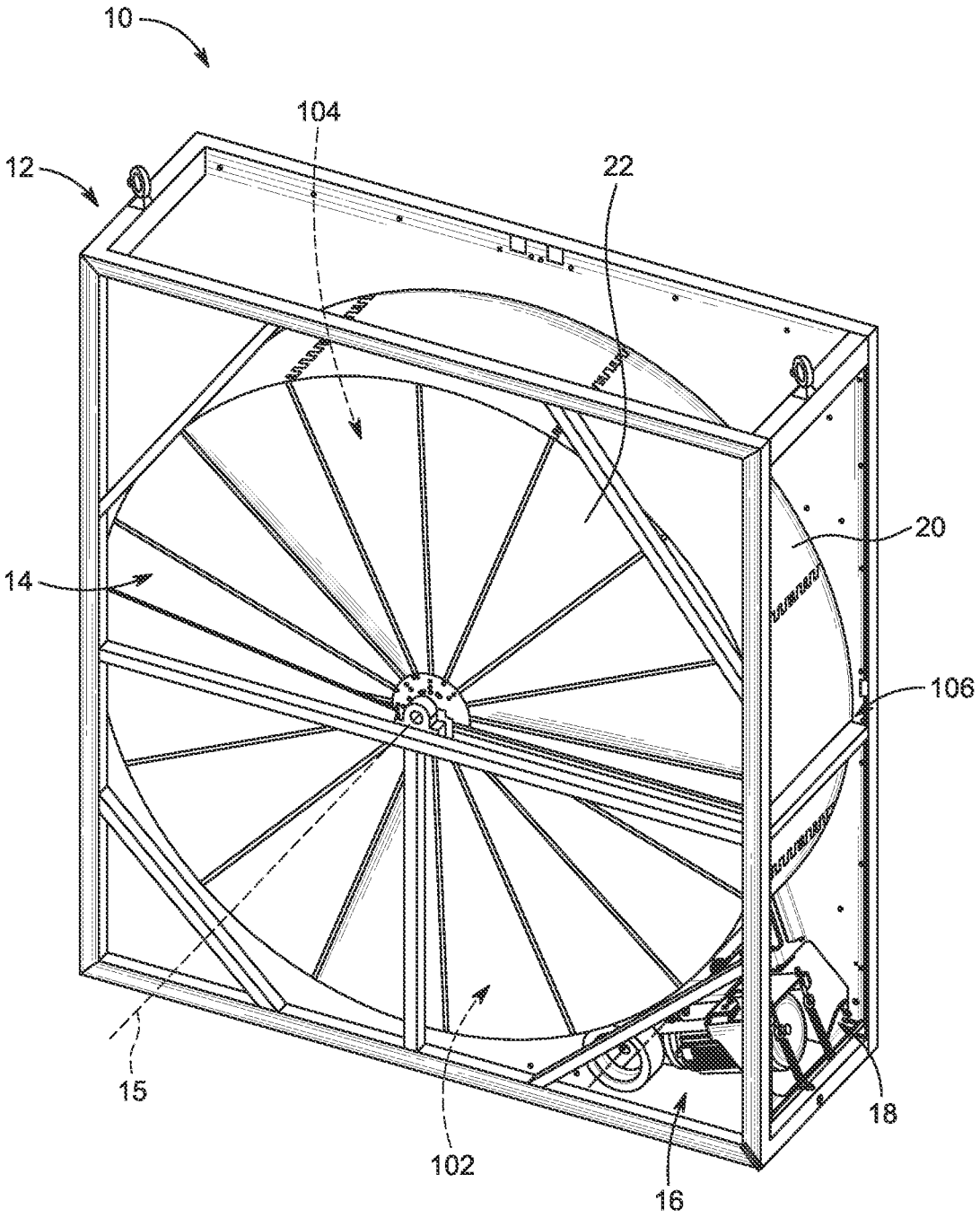
FIG. 1 is a perspective view of an exemplary energy recovery system for an air handling unit, the energy recovery system including an energy recovery wheel and a wheel actuator configured to rotate the energy recovery wheel about a rotation axis.

An energy recovery system 10 in accordance with the present disclosure, includes a support frame 12, an energy recovery wheel 14, and a wheel actuator 16 as shown in FIG. 1. The support frame 12 is configured to support the wheel actuator 16 within an air handling unit (not shown). The support frame 12 may form a part of the air-handling unit or may be separate from the air-handling unit and coupled to the energy recovery wheel 14 such that the support frame 12, energy recovery wheel 14, and wheel actuator 16 form a removable subassembly within the air-handling unit. The air handling unit includes or defines an air-supply section 102 that supplies outdoor air into a building and an air-exhaust section 104 that removes indoor air from the building at the same time to ventilate the building with fresh, outdoor air. The indoor air and the outdoor air both pass through the energy recovery wheel 14 to exchange heat and/or moisture between the indoor air and the outdoor air. The energy recovery wheel 14 is driven in rotation by the wheel actuator 16 relative to the air handling unit and is arranged to lie in both the air-supply section and the air-return section to exchange heat and/or moisture between the indoor air and the outdoor air in order to reduce energy losses.

The energy recovery wheel 14 rotates about a central rotational axis 15 relative to the support frame 12 so that portions of the energy recovery wheel 14 are continuously moved into and out of the air-supply section 102 and the air-return section 104 as the indoor and outdoor air flows there through. The energy recovery wheel 14 includes an outer shell 20 and an energy absorption media 22 arranged to lie within a perimeter of the outer shell 20. The outer shell 20 engages the wheel actuator 16 and is driven by the wheel actuator 16 to rotate the energy recovery wheel 14 about the central rotational axis 15 during operation of the energy recovery system 10. The expression "energy recovery wheel" should be interpreted to include, without limitation thereto, a rotary wheel, a thermal wheel, a sensible wheel, a heat wheel, a desiccant wheel, a dehumidification wheel, a heat and/or moisture recovery wheel, a total energy recovery wheel, a enthalpy wheel, a regeneratable rotary dehumidification wheel, a rotary enthalpy wheel, a rotating wheel exchanger and the like. The energy absorption media 22 may be corrugated or fluted sheets of material that absorbs heat and/or moisture from one of the indoor air and the outdoor air and releases the heat and/or moisture into the other of the indoor air and the outdoor air.

Figure 2:
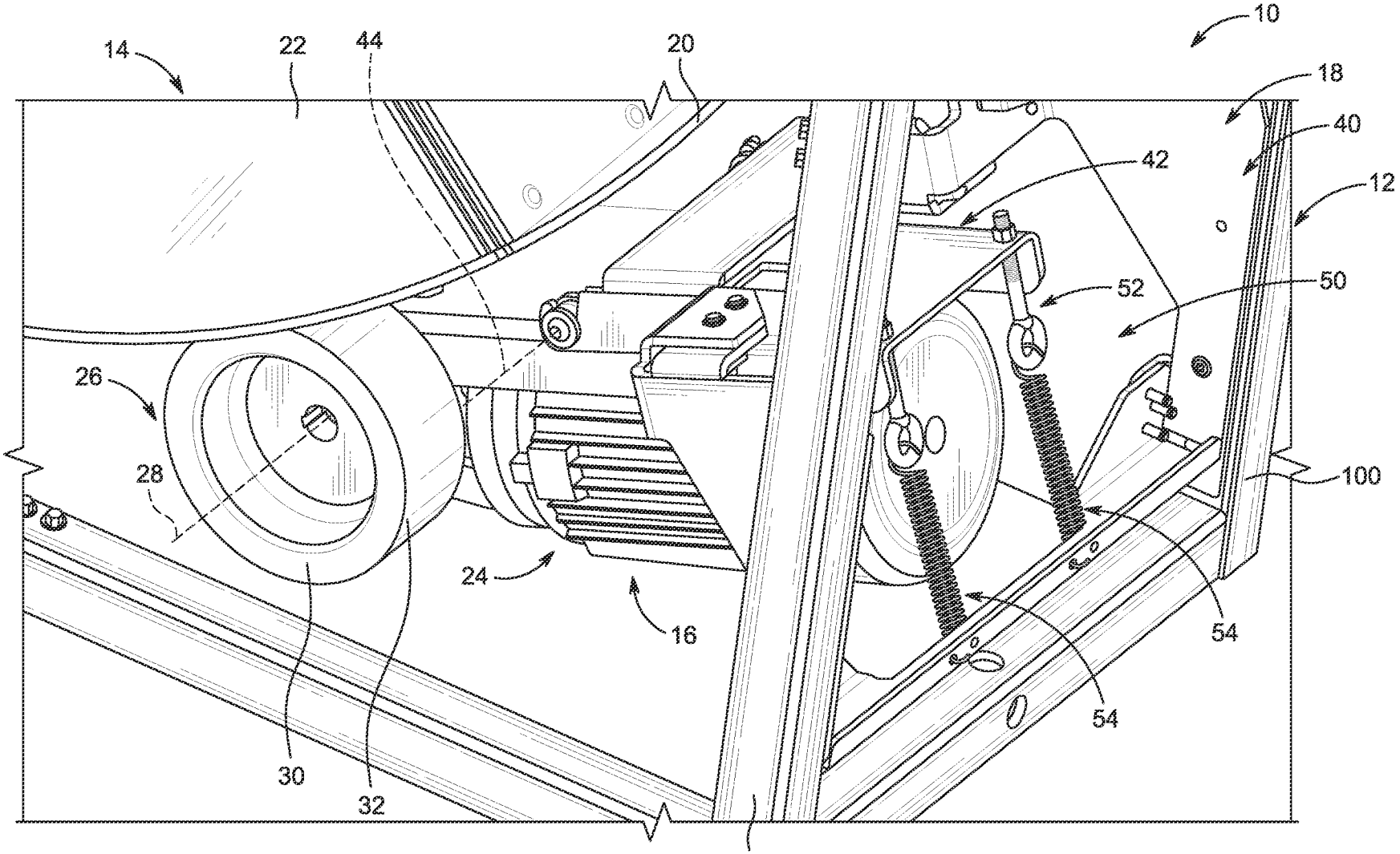
FIG. 2 is a perspective view of a portion of the energy recovery system of FIG. 1 showing the wheel actuator engaged directly with the energy recovery wheel.

The wheel actuator 16 is mounted to the support frame 12, or another portion of the air-handling unit, as shown in FIGS. 1 and 2. In the illustrative embodiment, the wheel actuator 16 is located at a lower corner of the support frame 12 relative to the energy recovery wheel 14, however, in other embodiments the wheel actuator 16 may be located in another location relative to the energy recovery wheel 14. The wheel actuator 16 includes a motor 24 and a drive wheel 26 coupled to the motor 24. The motor 24 is configured to drive rotation of the drive wheel 26 about a wheel rotation axis 28. The drive wheel 26 directly engages the outer shell 20 of the energy recovery wheel 14 and drives the energy recovery wheel 14 to rotate about the central rotational axis 15 during operation.

Figure 10:
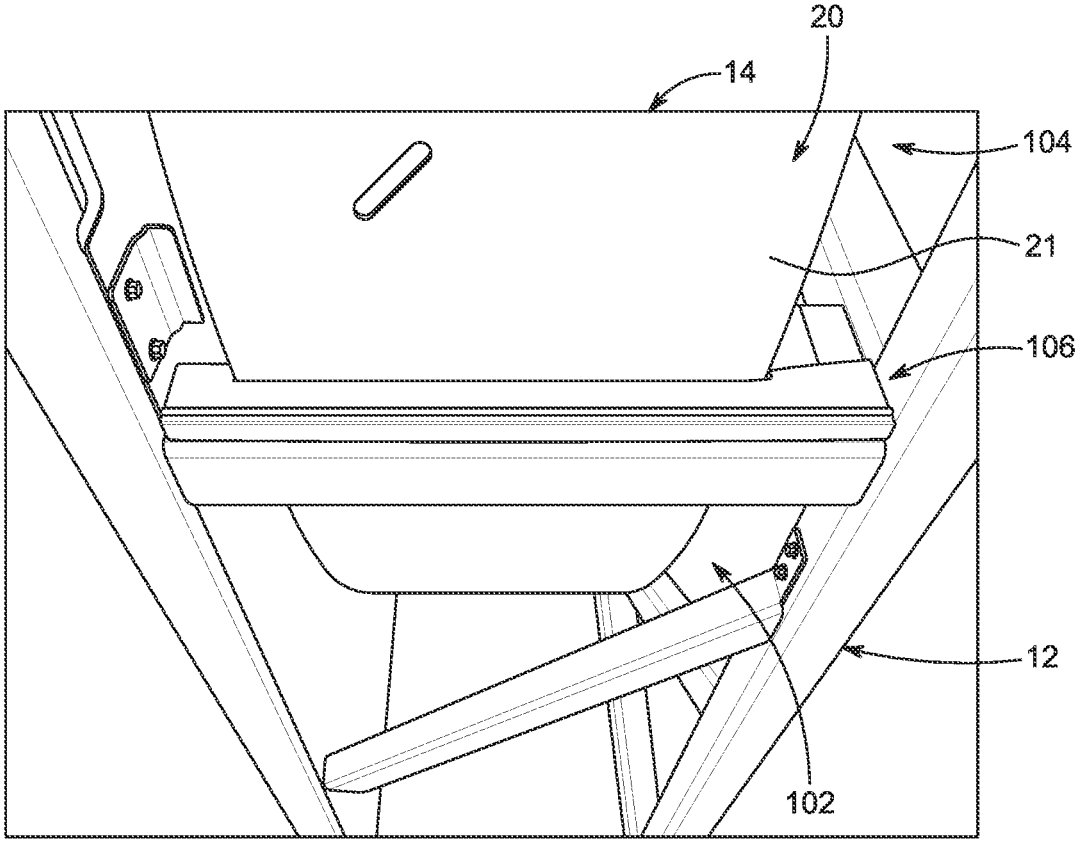
FIG. 10 is a side perspective view of the energy recovery system from FIG. 1 showing an interface between a seal member and the energy recovery wheel.

Some prior wheel actuators include a belt that wraps around the outer shell of the energy recovery wheel and that is driven by a drive wheel. However, in this instance the drive wheel is spaced apart from the outer shell and slots are formed in various seal members 106 separating the air-supply section 102 and the air-exhaust section 104 to provide clearance for the belt. Unlike systems using those prior wheel actuators, the drive wheel 26 in the illustrated embodiment is placed in direct contact with the outer shell 20 so that the belt and the corresponding slots in the seal members 106 can be omitted thereby improving efficiency of the system 10 as shown in FIG. 10. The seal member 106 interfaces with a radially-outer surface 21 of the outer shell 20 and extends generally parallel with the rotation axis 15 from a forward end of the outer shell 20 to a rear end of the outer shell 20. Each seal member 106 is formed without any slots opening toward the outer shell 20 between the forward end and the rear end.

The motor 24 may include an induction motor, a permanent magnet synchronous motor (PMSM), a direct PMSM motor, a direct induction motor, or any other suitable type of motor. The motor 24 may be brushed or brushless. The motor 24 may be powered via direct current (DC) or alternating current (AC), or may be an electrically communicated (EC) motor, in some embodiments.

Figure 5:
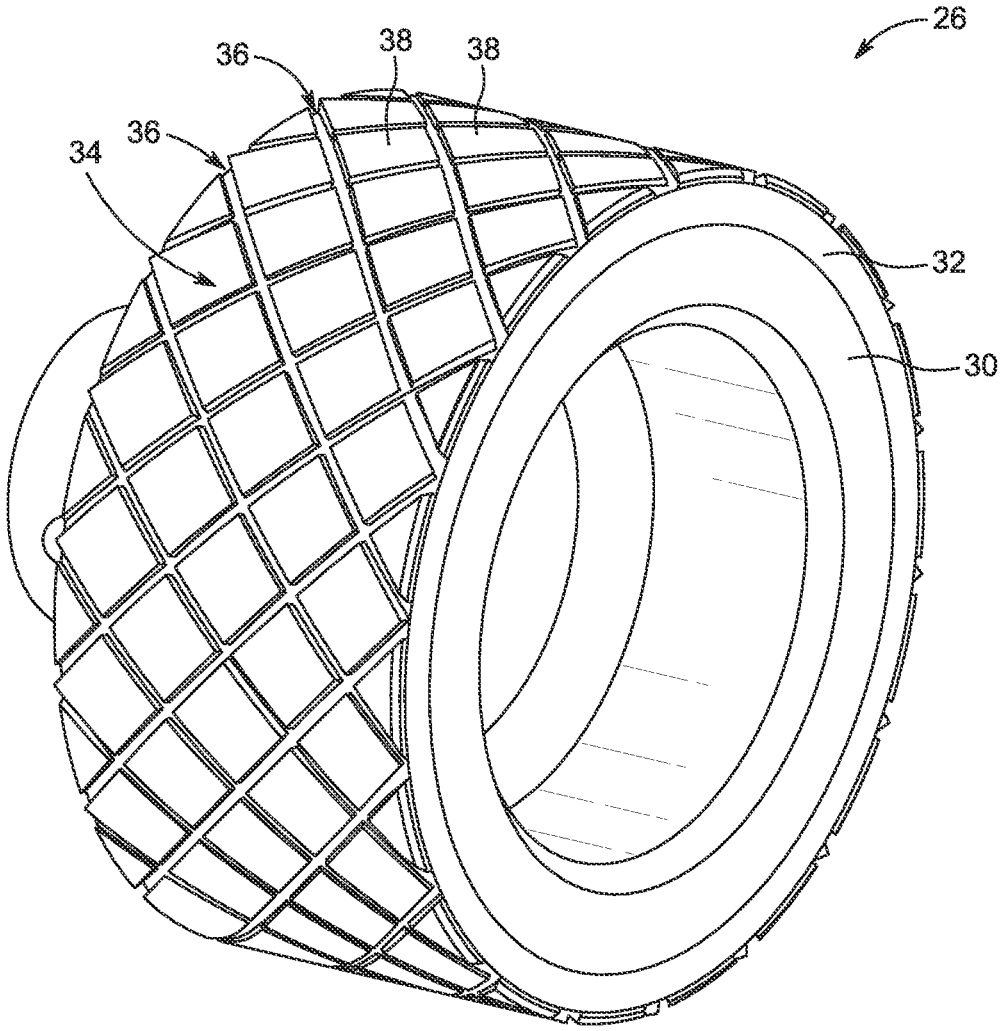
FIG. 5 is an enlarged perspective view of the drive wheel of the wheel actuator of FIG. 1.
Figure 6:
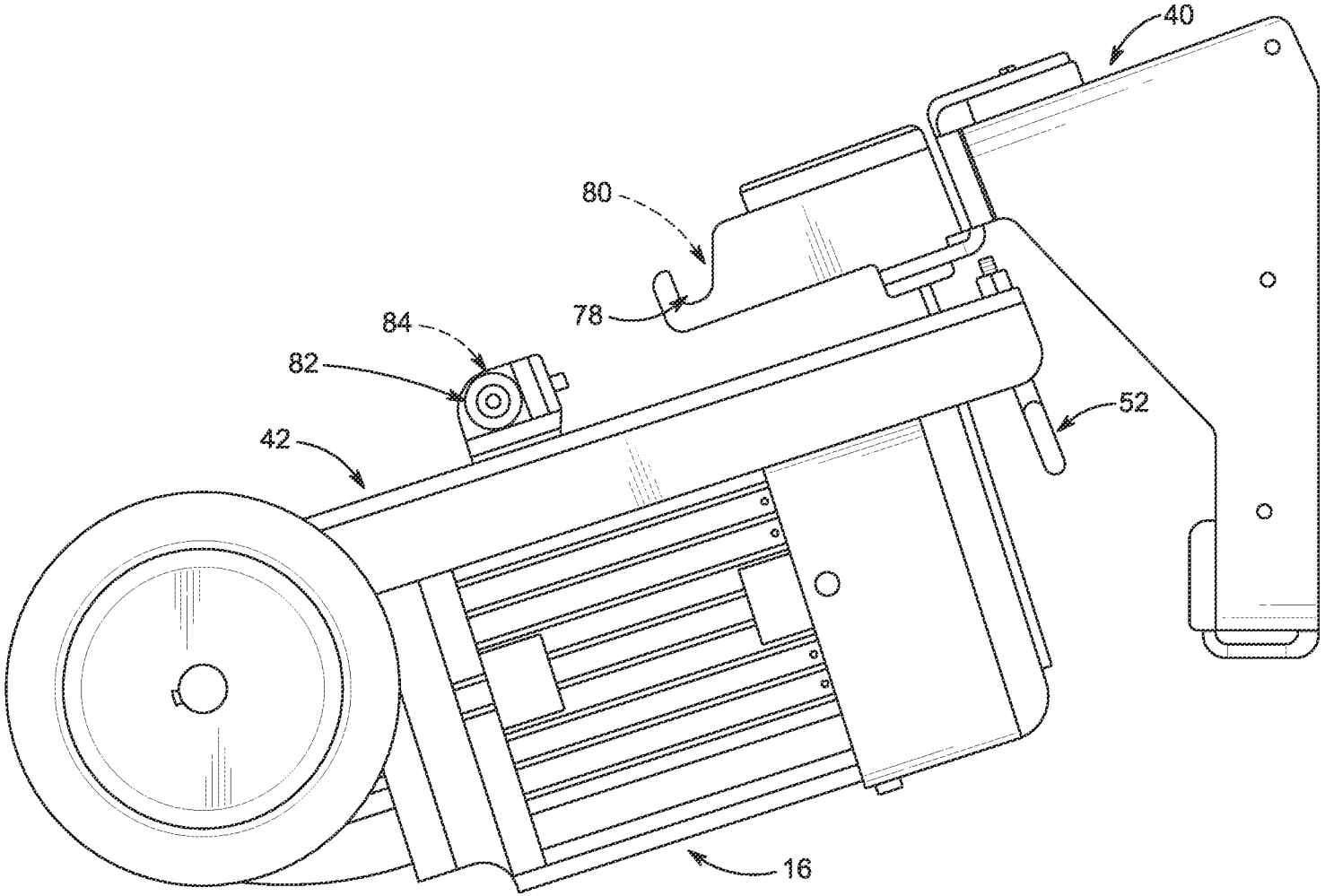
FIG. 6 is a side elevation view of the wheel actuator of FIG. 1 separated from a stationary actuator mount used to mount the motor and the drive wheel relative to the energy recovery wheel during an installation process.
Figure 7:
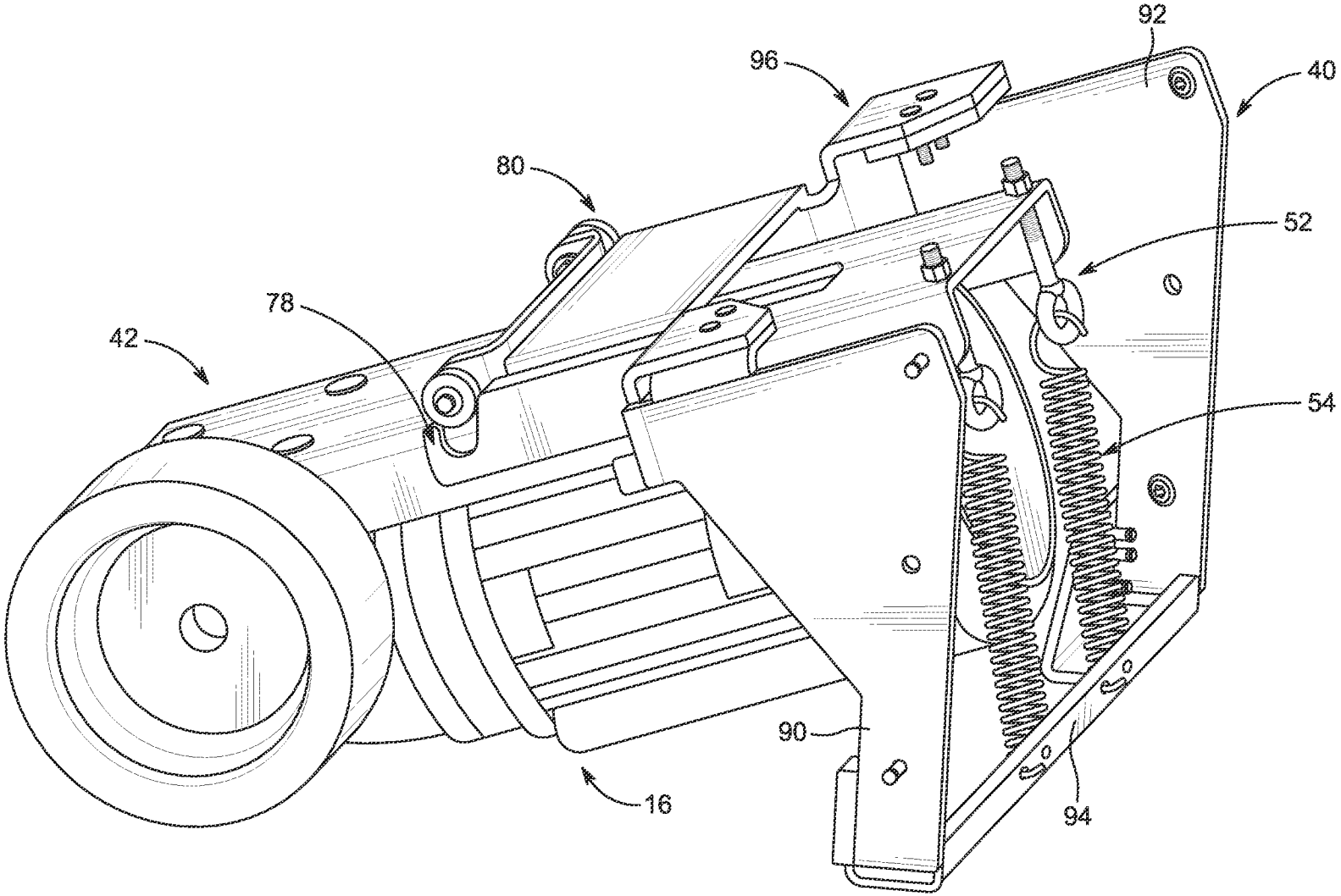
FIG. 7 is a perspective view of the wheel actuator of FIG. 1 showing a pair of mount rods coupled to the motor positioned above a pair of corresponding U-shaped channels formed in the stationary actuator mount.
Figure 8:
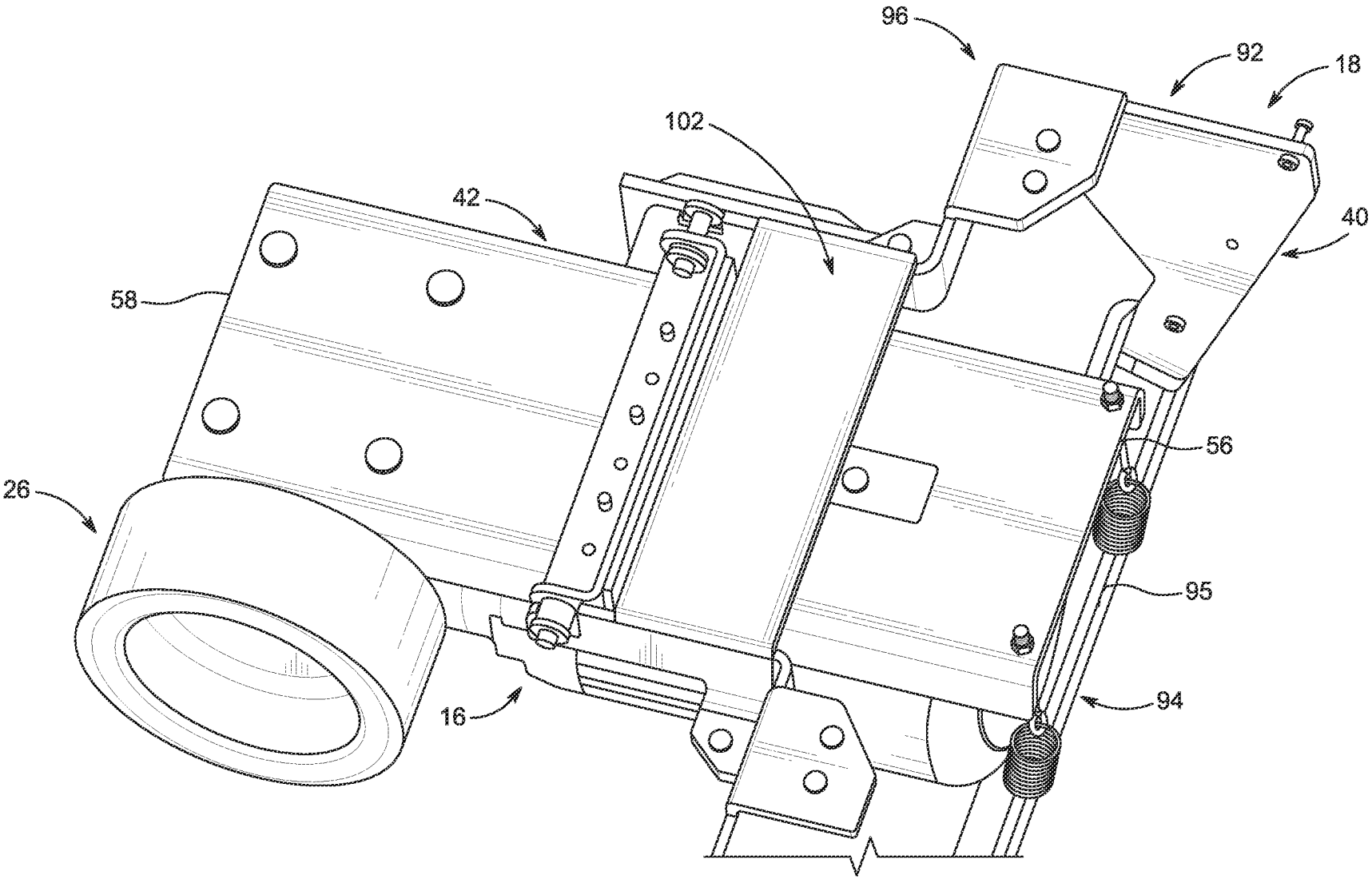
FIG. 8 is a perspective view of the wheel actuator of FIG. 1 showing the mount rods lowered into the corresponding U-shaped channels.

The drive wheel 26 includes a wheel hub 30 and a peripheral skin 32 that circumscribes an outer surface of the wheel hub 30 as shown in FIG. 5. The wheel hub 30 may be made from aluminum or any other suitable material and is solid to reduce inertia and energy consumption. The peripheral skin 32 may include polyurethane or another suitable material to increase friction between the drive wheel 26 and the outer shell 20. The peripheral skin 32 may have a flat outer surface or may be formed to include thread 34 to increase grip on the outer shell 20. The thread 34 is defined by a plurality of channels 36 formed into the peripheral skin 32. The plurality of channels 36 illustratively form a plurality of diamond-shaped pads 38, however, in other embodiments the plurality of channels 36 may define pads or structures having a different shape. The diamond-shaped pads 38 may reduce noise and heat and may increase durability of the peripheral skin compared to threads having pads with different shapes or no shape.

Figure 3:
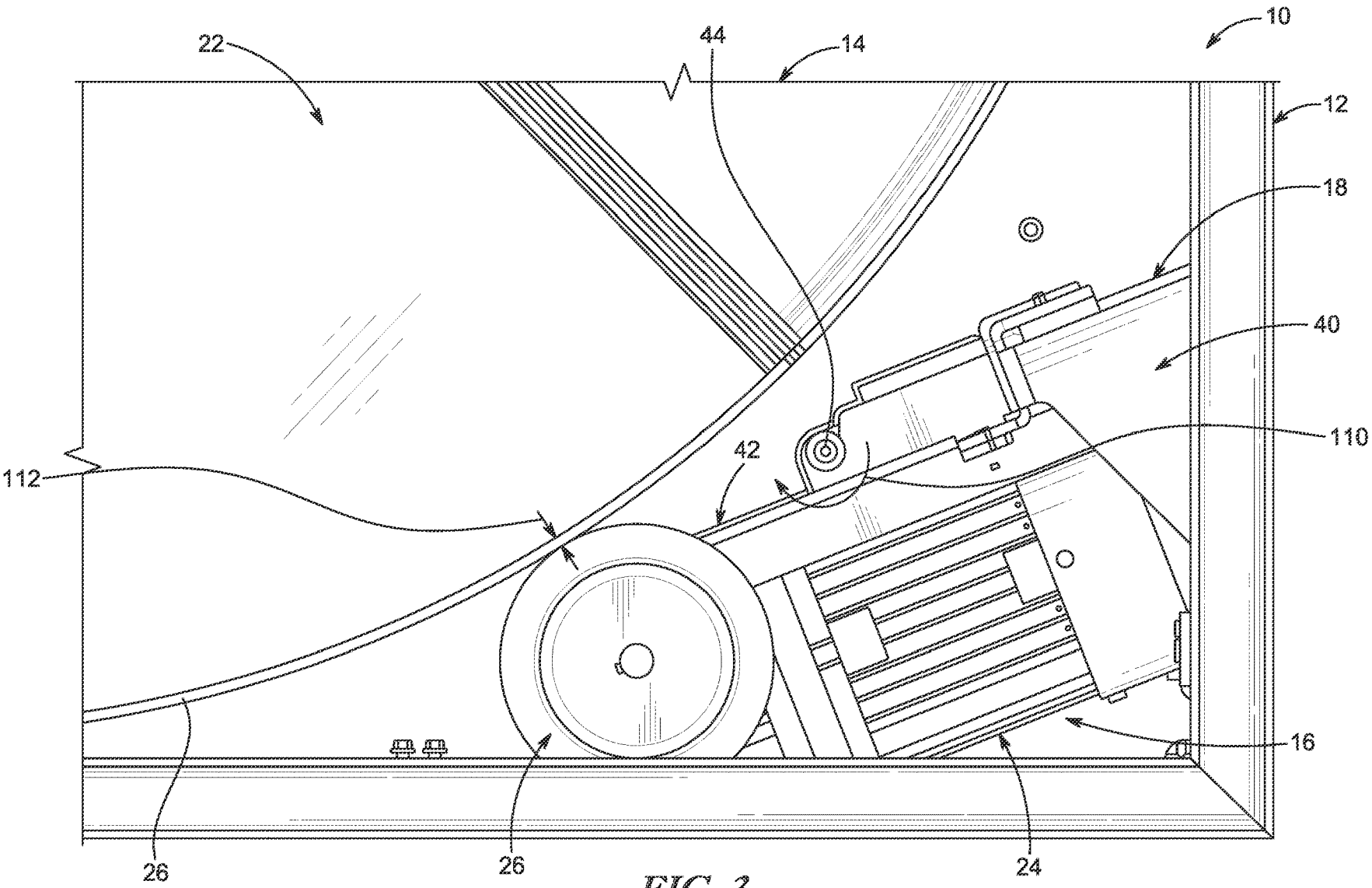
FIG. 3 is a side elevation view of the energy recovery system of FIG. 1 showing that the wheel actuator has a motor and a drive wheel that is biased into engagement with the energy recovery wheel.
Figure 4:
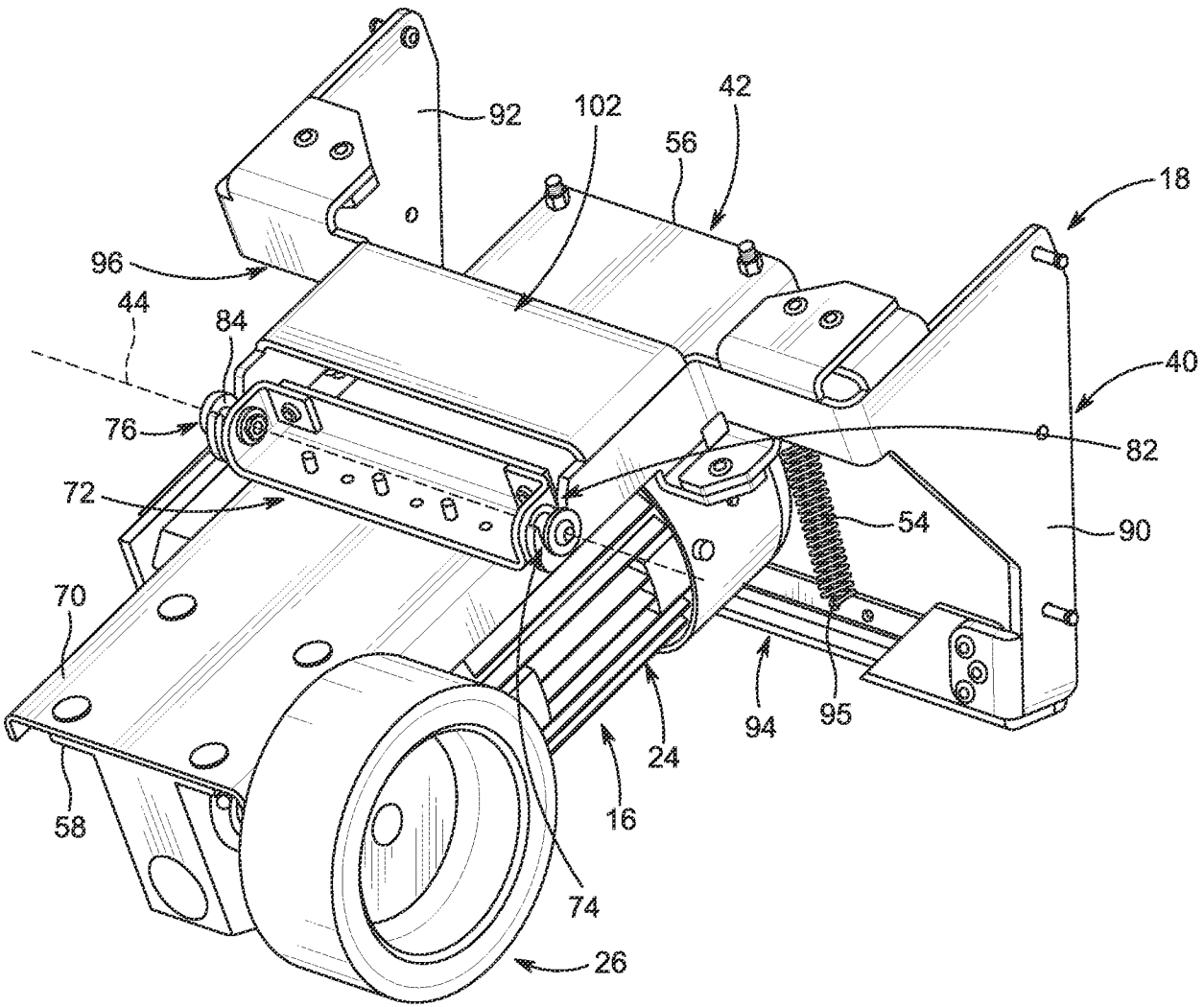
FIG. 4 is a perspective view of the wheel actuator from FIGS. 1-3.

The energy recovery system 10 further includes an actuator mount 18 configured to position and retain the wheel actuator 16 relative to the energy recovery wheel 16 as shown in FIGS. 1-3. The actuator mount 18 includes a stationary mount 40 and a motor mount 42 coupled to the wheel actuator 16. The stationary mount 40 is configured to couple to the support frame 12 in a fixed position relative to the energy recovery wheel 14. The motor mount 42 coupled to the stationary mount 40 and is configured to pivot about an actuator pivot axis 44 to allow movement of the wheel actuator 16 relative to stationary mount 40. Pivoting of the motor mount 42 allows the wheel actuator 16 to move relative to the energy recovery wheel 14 or remain in contact with the energy recovery wheel 14. In some embodiments, the stationary mount 40 is a part of the support frame 12 or a part of the air-handling unit.

The actuator mount 18 further includes a tensioning system 50 configured to bias the motor mount 42 to pivot about the actuator pivot axis 44 in direction 110 so that the drive wheel 26 is biased into contact with the outer shell 20 of the energy recovery wheel 14 and applies a load 112 on the outer shell 20. The tensioning system 50 includes a pair of adjustable spring mounts 52 coupled to the motor mount 42 and a corresponding pair of biasing springs 54. Each of the biasing springs 54 extends between the motor mount 42 and a portion of the stationary mount 40, although in other embodiments, the biasing springs 54 may be coupled to a portion of the support frame 12 or another part of the air-handling unit. Illustratively, the biasing springs 54 are tension springs and are coupled to a first end 56 of the motor mount 42 to bias an opposite, second end 58 of the motor mount 42 toward the energy recovery wheel 14. The actuator pivot axis 44 is located between the first end 56 and the second end 58 to provide this motion.

Although the illustrative embodiment includes two tension springs 54, it should be noted that any number of springs may be used to bias the second end 58 of the motor mount 42 and the drive wheel 26 toward the energy recovery wheel 14. In other embodiments, a different type of biasing element may be used in place of the tension springs 54 such as compression springs, torsion springs, leaf springs, hydraulics, elastic members, etc.

Figure 9:
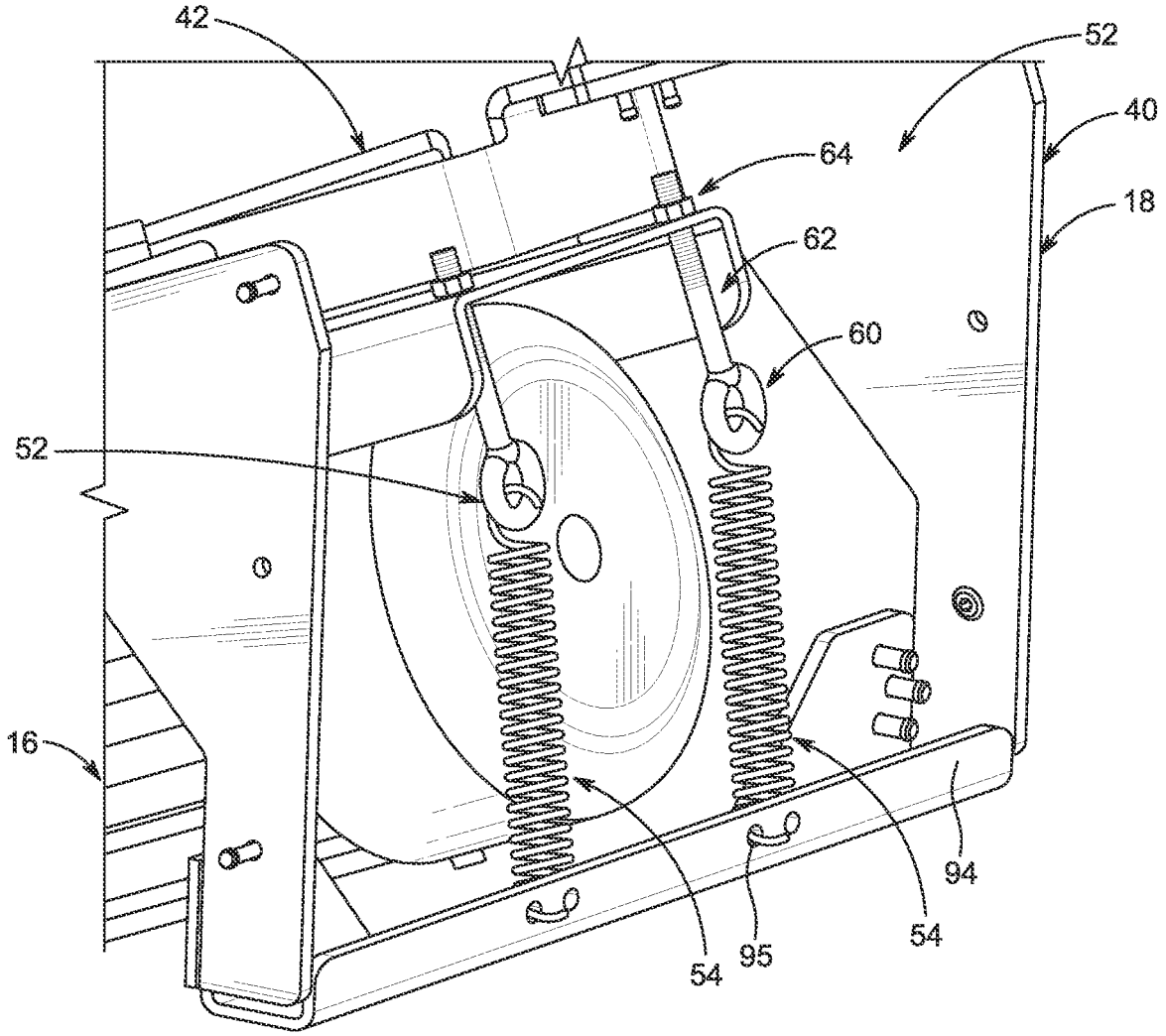
FIG. 9 is a perspective view of the wheel actuator of FIG. 1 showing a tensioning system including a pair of tension springs that apply a tensile force on the motor to bias the drive wheel into engagement with the energy recovery wheel.

Each biasing spring 54 is coupled to a corresponding adjustable spring mount 52 as shown in FIGS. 1 and 9. Each adjustable spring mount 52 is rotatable relative to the motor mount 42 to increase or decrease a spring force provided by the biasing springs 54 on the adjustable spring mount 54 and the first end 56 of the motor mount 42. Each adjustable spring mount 52 includes an eyelet 60 to which a respective biasing spring 54 is coupled a threaded shaft 62 coupled to the first end 56 of the motor mount 42. A nut 64 threadingly engages with a respective threaded shaft 62 to retain each adjustable spring mount 52 to the motor mount 42. The threaded shaft 62 may threadingly engage with the motor mount 42 such that the retainer nut 64 can be omitted. Rotation of the nut 64 and/or the threaded shaft 62 of each adjustable spring mount increases or decreases a distance between the eyelet 60 and the motor mount 42 to increase or decrease the force provided by each spring 54 on each respective adjustable spring mount 52.

The motor mount 42 includes a mount plate 70 supporting the wheel actuator 24, a mount bracket 72 coupled to the mount plate 70, and a pair of mount rods 74, 76 coupled to the mount bracket 72 and extending outwardly from the mount plate 70. The mount rods 74, 76 are arranged along the actuator pivot axis 44 and set within u-shaped channels 78, 80 formed in the stationary mount 40 to support the motor mount 42 on the stationary mount 40.

The motor mount 42 may further include a vibration-dampening bushing 82, 84 coupled to each mount rod 74, 76. Each vibration-dampening bushing 82, 84 is at least partially received within a corresponding channel 78, 80 to lie between a corresponding mount rod 74, 76 and the stationary mount 40 to dampen vibrations produced by the wheel actuator 16 during operation.

The stationary mount 40 includes a pair of side brackets 90, 92, a base crossbeam 94, and a motor-mount support 96 as shown in FIG. 3. The pair of side brackets 90, 92 are spaced apart from one another by a distance that corresponds with a width of the support frame 12 so that each side bracket 90, 92 can be attached to corresponding frame members 98, 100 of the support frame 12 as shown in FIG. 1. The base crossbeam 94 extends between the side brackets 90, 92 and is formed to include apertures 95 that can be used to attach an end of each biasing spring 54. The motor-mount support 96 also extends between the side brackets 90, 92 and is configured to position the motor mount 42 and the wheel actuator 16 adjacent to the energy recovery wheel 14.

The u-shaped channels 78, 80 are formed in the motor-mount support 96 and open upwardly so that the mount rods 74, 76 can be lowered into each corresponding channel 78, 80 during installation as suggested in FIGS. 6-9. Once the mount rods 74, 76 are set within the u-shaped channels 78, 80, the biasing springs 54 can be attached to each adjustable spring mount 52 and the base crossbeam 94 via apertures 95. The motor mount support includes an upper crossbeam 102 located above the motor mount 42 to block over-rotation of the motor mount 42 during installation. The mount rods 74, 76 are held by gravity in each u-shaped channel 78, 80, but tension provided by the biasing springs 54 also helps retain the mount rods 74, 76 in the u-shaped channels 78, 80.

Figure 11:
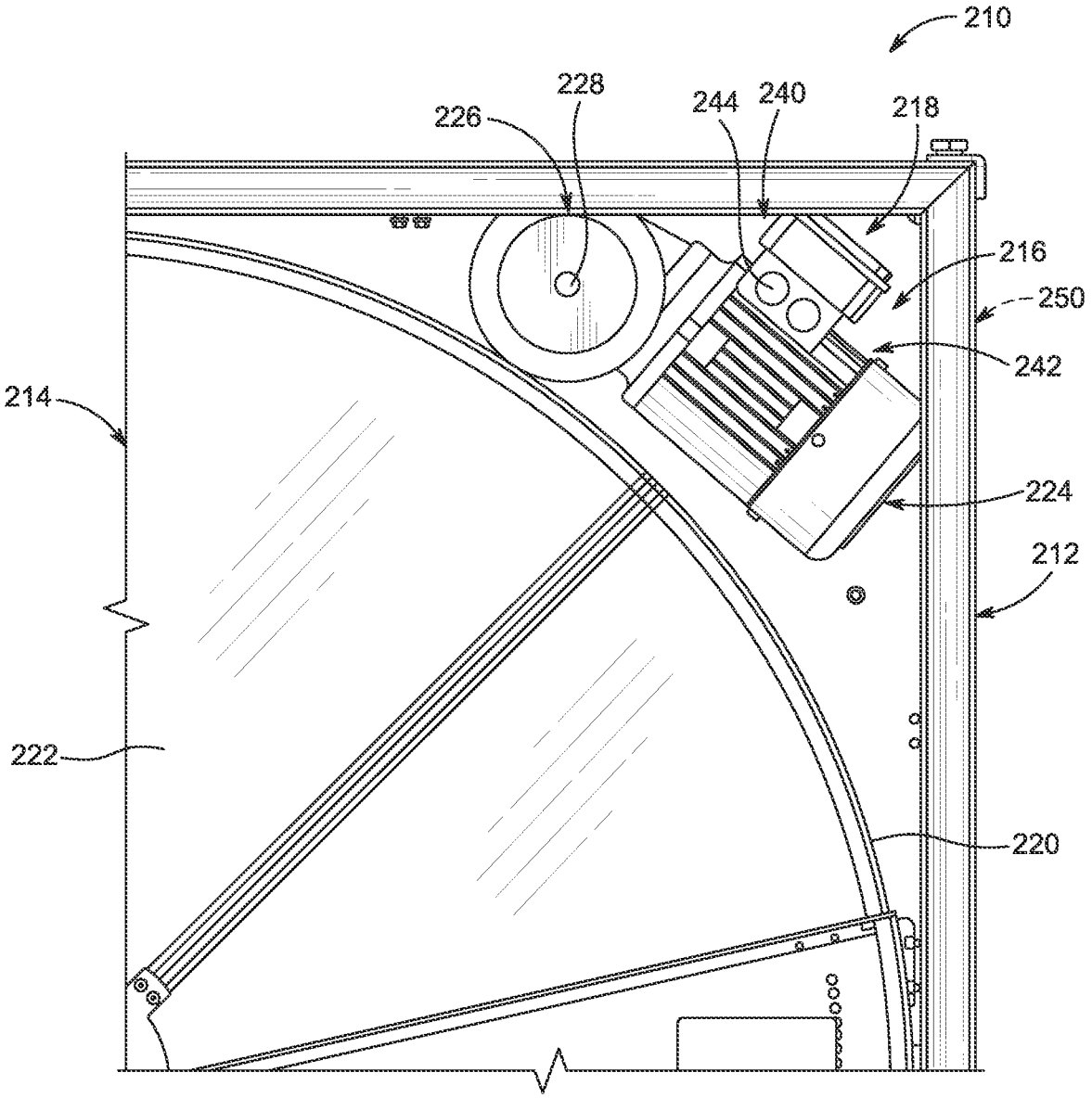
FIG. 11 is a side elevation of another energy recovery assembly including an energy recovery wheel and a second embodiment of a wheel actuator having a motor and a drive wheel that is biased, at least partially, by gravity into direct engagement with the energy recovery wheel and configured to drive the energy recovery wheel to rotate about a rotation axis.

Another embodiment of an energy recovery system 210 is shown in FIG. 11. The energy recovery system 210 is substantially similar to energy recovery system 10 and includes a support frame 212, an energy recovery wheel 214, and a wheel actuator 216. Similar reference numbers in the 200 series are used to describe similar features between energy recovery system 210 and energy recovery system 10. Accordingly, the disclosure of energy recovery system 10 is incorporated by reference for energy recovery system 210.

The wheel actuator 216 includes a motor 224 and a drive wheel 226 coupled to the motor 24. The motor 24 is configured to drive rotation of the drive wheel 26 about a wheel rotation axis 228. The drive wheel 226 directly engages the outer shell 220 of the energy recovery wheel 214 and drives the energy recovery wheel 14 to rotate about a central rotational axis during operation.

The energy recovery system 210 further includes an actuator mount 218 configured to position and retain the wheel actuator 216 relative to the energy recovery wheel 16 as shown in FIG. 11. The actuator mount 218 includes a stationary mount 240, a motor mount 242 coupled to the wheel actuator 216, and a tensioning system 250. The stationary mount 240 is coupled to the support frame 212 in a fixed position relative to the energy recovery wheel 214. The stationary mount 240 is located in an upper half of the support frame 212 to use gravity to at least partially bias the wheel actuator 216 into contact with the energy recovery wheel 214. The motor mount 242 is coupled to the stationary mount 240 and is configured to pivot about an actuator pivot axis 244 to allow movement of the wheel actuator 216 relative to the energy recovery wheel 214 while supporting the wheel actuator 216 relative to the energy recovery wheel 216. In some embodiments, the stationary mount 240 is a part of the support frame 212 or a part of the air-handling unit. The tensioning system 250 is optional but, if included, is configured to bias the motor mount 242 to pivot about the actuator pivot axis 244 so that the drive wheel 226 is biased into contact with the outer shell 220 of the energy recovery wheel 214.

Figure 12:
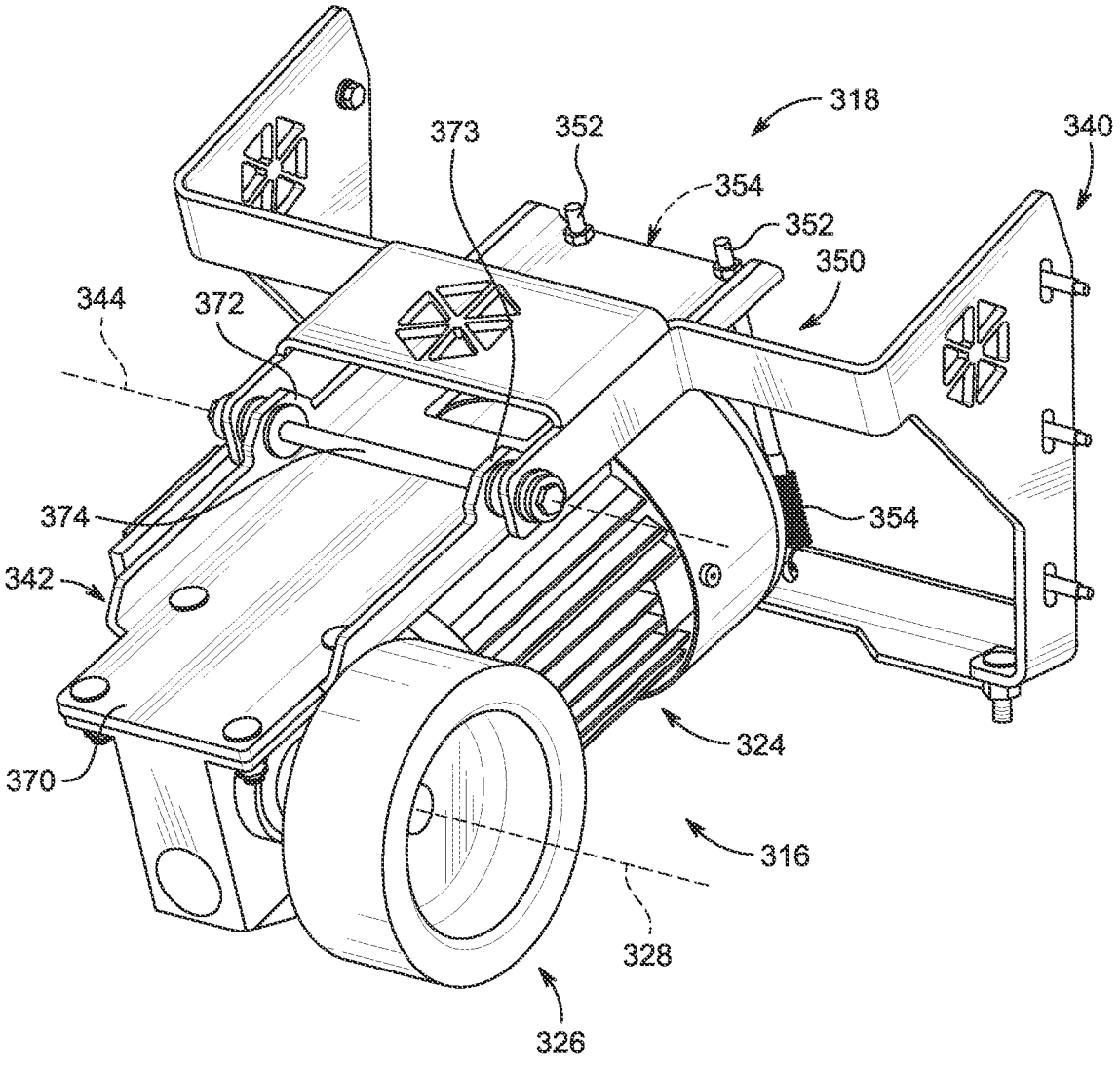
FIG. 12 is a perspective view of a third embodiment of a wheel actuator that can be used with the energy recovery system of FIG. 1.
Figure 13:
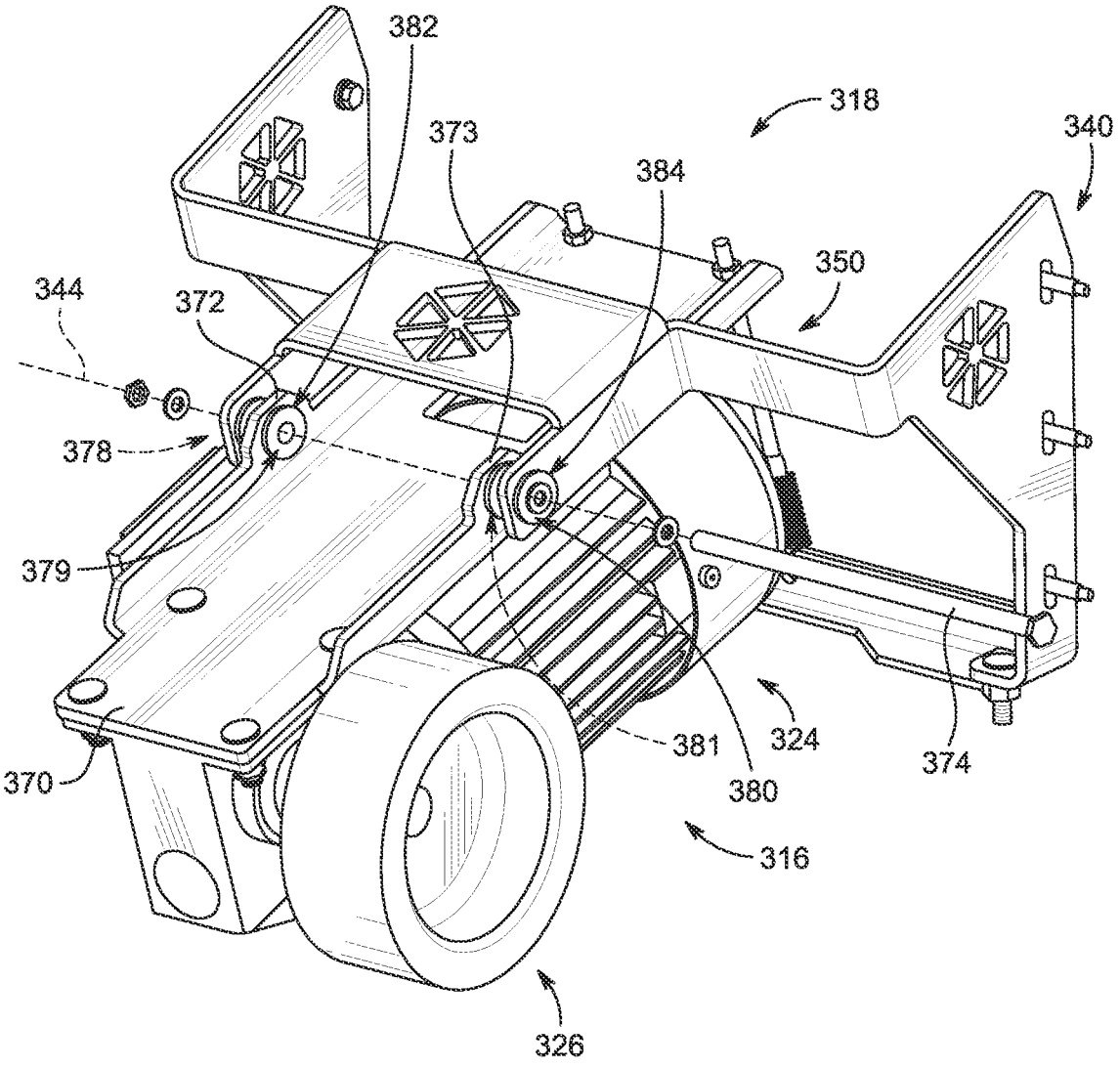
FIG. 13 is an exploded assembly view of the wheel actuator shown in FIG. 12.

Another embodiment of a wheel actuator 316 and an actuator mount 318 that can be used with energy recovery system 10, 210 is shown in FIGS. 12 and 13. The wheel actuator 316 and the actuator mount 318 are substantially similar to wheel actuator 16 and actuator mount 18, respectively. Similar reference numbers in the 300 series are used to describe similar features between wheel actuator 316 and actuator mount 318 are and wheel actuator 16 and actuator mount 18, respectively. Accordingly, the disclosure of wheel actuator 16 and actuator mount 18 is incorporated by reference for wheel actuator 316 and actuator mount 318.

The wheel actuator 316 includes a motor 324 and a drive wheel 326 coupled to the motor 324. The motor 324 is configured to drive rotation of the drive wheel 326 about a wheel rotation axis 328. The drive wheel 326 directly engages the outer shell 20 of the energy recovery wheel 14 and drives the energy recovery wheel 14 to rotate about the central rotational axis 15 during operation.

The actuator mount 318 configured to position and retain the wheel actuator 316 relative to the energy recovery wheel 14. The actuator mount 218 includes a stationary mount 240, a motor mount 242 coupled to the wheel actuator 216, and a tensioning system 250. The stationary mount 240 is coupled to the support frame 212 in a fixed position relative to the energy recovery wheel 214.

The tensioning system 350 includes a pair of adjustable spring mounts 352 coupled to the motor mount 342 and a corresponding pair of biasing springs 354. Each of the biasing springs 354 extends between the motor mount 342 and a portion of the stationary mount 340, although in other embodiments, the biasing springs 354 may be coupled to a portion of the support frame 12 or another part of the air-handling unit. Each biasing spring 354 is coupled to a corresponding adjustable spring mount 352. Each adjustable spring mount 352 is rotatable relative to the motor mount 342 to increase or decrease a spring force provided by the biasing springs 354 on the adjustable spring mount 354 and the motor mount 342.

The motor mount 342 includes a mount plate 370 supporting the wheel actuator 324, a pair of mount flanges 372, 373 coupled to the mount plate 370, and a mount rod 374. The pair of mount flanges 372, 373 are coupled to opposite lateral sides of the mount plate 370 and extend upwardly away from the mount plate 370. Each mount flange 372, 373 is formed to include a mount aperture 379, 381. The mount rod 374 is arranged along the actuator pivot axis 344 and received within apertures 378, 380 formed in the stationary mount 340 and apertures 379, 381 formed in mount flanges 372, 373 to support the motor mount 342 on the stationary mount 340.

The motor mount 342 may further include a vibration-dampening bushing 382, 384 coupled to at least one of the mount rod 374, the mount flanges 372, 373, and/or the stationary mount 340. Each vibration-dampening bushing 382, 384 may be at least partially received within a corresponding aperture 378, 380 to lie between the mount rod 374 and the stationary mount 340 to dampen vibrations produced by the wheel actuator 316 during operation. Vibration-dampening bushings 382, 384 may also be arranged to lie in apertures 379, 381 to lie between the mount flanges 372, 373 and the mount rod 374. The mount rod 374 has a length that is greater than a distance between apertures 378, 380 so that the mount rod extends past each aperture 378, 380.

The invention claimed is:

1. An energy recovery system for an air handling unit comprising an energy recovery wheel configured to rotate about a central axis, a wheel actuator including a motor and a drive wheel coupled to the motor for rotation about a wheel axis that is offset from the central axis and the energy recovery wheel to drive rotation of the energy recovery wheel about the central axis, and an actuator mount configured to position and retain the wheel actuator relative to the energy recovery wheel, the actuator mount including a stationary mount coupled in a fixed position relative to the energy recovery wheel, a motor mount coupled to the stationary mount for pivotable movement about an actuator pivot axis and configured to support the wheel actuator relative to the energy recovery wheel, and a tensioning system configured to bias the motor mount to pivot about the actuator pivot axis so that the drive wheel is biased into contact with the energy recovery wheel;

wherein the motor mount includes a first mount flange formed to include a first flange aperture, a second mount flange spaced apart from the first mount flange along the actuator pivot axis and formed to include a second flange aperture, and a mount pin received within the first mount flange, the second mount flange, and at least one stationary-mount aperture formed in the stationary mount to couple the motor mount and the wheel actuator to the stationary mount.

2. The energy recovery system of claim 1, wherein the motor mount includes a mount plate supporting the wheel actuator, a mount rod extending along the actuator pivot axis, and a vibration dampening bushing coupled to the mount rod and arranged to lie between the mount rod and the stationary mount to dampen vibrations produced by the actuator.

3. The energy recovery system of claim 1, wherein further comprising a first vibration dampening bushing arranged to lie between the mount pin and the first mount flange and a second vibration dampening bushing arranged to lie between the mount pin and the second mount flange.

4. The energy recovery system of claim 1, wherein the tensioning system includes a tension spring coupled to a first end of the motor mount to bias an opposite, second end of the motor mount toward the energy recovery wheel, the drive wheel being coupled to the motor at the second end of the motor mount.

5. The energy recovery system of claim 4, wherein the tensioning system further includes an adjustable spring mount coupled to the motor mount, and wherein the tension spring is coupled to an end of the spring mount spaced apart from the motor mount at the first end to bias the second end of the motor mount toward the energy recovery wheel.

6. The energy recovery system of claim 5, wherein the adjustable spring mount is rotatable relative to the motor mount to increase or decrease a spring force provided by the tension spring on the adjustable spring mount.

7. An energy recovery system for an air handling unit comprising an energy recovery wheel configured to rotate about a first axis, a motor, and a drive wheel coupled to the motor for rotation about a second axis that is offset from the first axis and the energy recovery wheel and having an outer surface engaged directly with an outer surface of the energy recovery wheel;

an actuator mount configured to support the motor relative to the energy recovery wheel, the actuator mount comprising a motor mount coupled to the motor and a stationary mount configured to be coupled to the air handling unit in a fixed position and configured to support the motor mount for pivotable movement about an actuator pivot axis so that the drive wheel is pivotable into contact with the outer surface of the energy recovery wheel;

wherein the motor mount comprises a mount plate supporting the motor, a pair of mount flanges coupled to the mount plate, and a mount rod coupled to the mount flanges and providing the actuator pivot axis.

8. The energy recovery system of claim 7, further comprising a vibration dampening bushing coupled to the mount rod and arranged to lie between the mount rod and at least one of the stationary mount and the mount plate to dampen vibrations therebetween.

9. The energy recovery system of claim 7, further comprising a tensioning system configured to bias the motor to pivot about the actuator pivot axis so that the drive wheel is urged into contact with the outer surface of the energy recovery wheel.

10. The energy recovery system of claim 9, wherein the tensioning system includes an adjustable spring mount coupled to the motor and a tension spring coupled to the adjustable spring mount.

11. The energy recovery system of claim 10, wherein the adjustable spring mount is adjustable relative to the motor to increase or decrease a spring force provided by the tension spring on the adjustable spring mount.

12. An energy recovery system for an air handling unit, the energy recovery system comprising a support frame including a plurality of side frame members at least partially defining an air-supply section and an air-return section and a seal member arranged between the air-supply section and the air-return section, an energy recovery wheel positioned within the air-supply section and the air-return section and configured to rotate about a rotation axis that is between the air-supply section and the air-return section, the energy recovery wheel including an outer shell extending circumferentially around the rotation axis and an energy absorption media between the outer shell and the rotation axis, and a wheel actuator configured to drive the energy recovery wheel to rotate about the rotation axis, wherein the seal member interfaces with a radially-outer surface of the outer shell and extends generally parallel with the rotation axis from a forward end of the outer shell to a rear end of the outer shell and is formed without any slots opening toward the outer shell between the forward end and the rear ends an actuator mount configured to position and retain the wheel actuator relative to the energy recovery wheel, the actuator mount including a stationary mount coupled in a fixed position relative to the energy recovery wheel, a motor mount coupled to the stationary mount for pivotable movement about an actuator pivot axis and configured to support the wheel actuator relative to the energy recovery wheel, and a tensioning system configured to bias the motor mount to pivot about the actuator pivot axis so that the wheel actuator is biased into contact with the energy recovery wheel; wherein the motor mount includes a mount plate configured to support a motor of the wheel actuator, a pair of mount flanges coupled to the mount plate, and a mount rod coupled to the mount flanges and providing the actuator pivot axis.

13. The energy recovery system of claim 12, further comprising a vibration dampening bushing coupled to the mount rod and arranged to lie between the mount rod and at least one of the stationary mount and the mount plate to dampen vibrations.

14. The energy recovery system of claim 12, wherein the wheel actuator includes a motor and a drive wheel driven in rotation by the motor, and wherein the drive wheel is biased into direct contact with the radially-outer surface of the energy recovery wheel so that only the drive wheel drives the energy recovery wheel to rotate about the rotation axis.

15. The energy recovery system of claim 12, wherein the tensioning system includes an adjustable spring mount coupled to the motor mount and a tension spring coupled to the adjustable spring mount.

16. The energy recovery system of claim 15, wherein the adjustable spring mount is adjustable relative to the motor mount to increase or decrease a spring force provided by the tension spring on the adjustable spring mount.

* * * * *